United States Patent [19]

Nayak

[11] Patent Number: 5,055,081

[45] Date of Patent: Oct. 8, 1991

[54] PLAY TABLE AND ACTIVITY CENTER

[75] Inventor: Devdas U. Nayak, Calgary, Canada

[73] Assignee: Lasy of North America Ltd., Canada

[21] Appl. No.: 429,390

[22] Filed: Oct. 31, 1989

[51] Int. Cl.[5] ..... A63H 33/08; A47B 85/00

[52] U.S. Cl. ..... 446/75; 446/71; 446/118; 108/26

[58] Field of Search ..... 446/118, 128, 71, 75, 446/85; 108/26, 13, 132; 273/309

[56] References Cited

U.S. PATENT DOCUMENTS

| | | | |
|---|---|---|---|
| 1,568,154 | 1/1926 | Hannon et al. | 108/26 X |
| 2,199,745 | 5/1940 | Harris | 273/309 |
| 3,556,529 | 3/1971 | Kner et al. | 446/118 |
| 4,513,974 | 4/1985 | Lin | 273/287 X |
| 4,813,904 | 3/1989 | Larws | 446/118 |
| 4,822,314 | 4/1989 | O'Brian et al. | 446/118 X |
| 4,872,410 | 10/1989 | Lilly | 446/128 X |

FOREIGN PATENT DOCUMENTS

| | | | |
|---|---|---|---|
| 60522 | 11/1954 | France | 446/118 |
| 2055299 | 3/1981 | United Kingdom | 273/309 |

*Primary Examiner*—Mickey Yu

*Attorney, Agent, or Firm*—Lerner, David, Littenberg, Krumholz & Mentlik

[57] ABSTRACT

A play table and activity center for use with a modular building system having a multitude of interlocking elements has a generally planar play surface which includes a plurality of recesses sized and shaped to matingly receive the interlocking elements of the modular building system. Preferably, the recesses are provided by individual segments which are assembled to collectively define the play surface, the individual segments being removable for use at a remote location and to facilitate the cleaning of the play table. An opening in the play surface provides access to a removable storage compartment for retaining the interlocking elements of the building system. Optionally, the play table may be converted into a substantially conventional table by assembling a flat panel above the play surface.

18 Claims, 4 Drawing Sheets

PLAY TABLE AND ACTIVITY CENTER

BACKGROUND OF THE INVENTION

The present invention relates to a play table, and in particular, to a play table for use with the elements of a modular building system.

Modular building systems have long been a popular play toy for children. Such systems generally consist of individual building elements having a variety of sizes and shapes which are designed to interconnect and interlock with one another to form a structure. Typically, the individual elements may be connected in a number of different orientations so that the structures which may be created thereby are limited only by the imagination of the child. The elements of one such modular building system are disclosed in U.S. Pat. No. 3,838,535.

One of the problems encountered with such systems is that a child will frequently attempt to assemble a structure which cannot support itself upright on a horizontal surface. Thus, those structures which are not supported beneath their center of gravity tend to topple over under their own weight. This limits the structures that a child may create when playing in a conventional setting, such as on a floor or table.

In addition, the quantity of individual elements utilized in such systems often creates a clean-up problem. As a child plays with such systems, the individual elements tend to become scattered about a large area. As is generally the case, it is difficult to get children to collect the elements and store them neatly for future use.

Thus, the need exists for a play surface which will support a structure during and after its assembly from the individual elements of a modular building system and thereby prevent it from toppling over. There is also a need for a convenient storage device which will facilitate the accumulation and storage of the individual elements of the modular building system.

SUMMARY OF THE INVENTION

The present invention addresses these needs by providing a play table for use with a modular building system which has a plurality of interlocking elements comprising a generally planar member having a first region and a second region, the first region defining an opening through the planar member and the second region defining a play surface which includes a plurality of recesses sized and shaped to matingly receive the interlocking elements of the modular building system. The play table further includes a storage compartment associated with the first region for retaining the interlocking elements and connecting means for removably connecting the storage compartment to the planar member in communication with the opening. Preferably, the play table also includes support means to support the planar member a predetermined distance from a horizontal surface.

In accordance with one embodiment of the invention, the recesses have a square cross-section the sides of which have a predetermined dimension, the recesses being spaced apart by the predetermined dimension in directions perpendicular to the sides of the recesses. The predetermined dimension is chosen so that the recesses may matingly engage with the uniform dimensions of the interlocking elements of the modular building system. Desirably, the play surface will comprise at least one removable segment which provides the plurality of recesses.

In yet another embodiment, the connecting means provides means for maintaining the storage compartment in a closed condition upon removal of the storage compartment from the planar member.

In a preferred embodiment, the connecting means comprises a hook and loop connector. A first portion of the hook and loop connector is fixedly attached to the planar member and an opposite portion of the hook and loop connector is fixedly attached to the storage compartment for mating engagement with the first portion.

Optionally, the table may include a panel removably disposed atop and coextensive with the planar member to define on the planar member a substantially flat upper surface. Preferably, at least one side of the panel includes illustrations of designs which are reproducible by assembling the interlocking elements on the play surface.

Preferred embodiments of the present invention provide a play table having a planar surface configured to connect with and support the elements of a modular building system. In addition, preferred embodiments of the present invention provide a play table having a storage compartment disposed to facilitate the collection and storage of the individual elements of the modular building system.

Moreover, the preferred play table according to the present invention has relatively simple construction which may readily be converted into a substantially conventional table having a flat upper surface.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION

Figure 1:
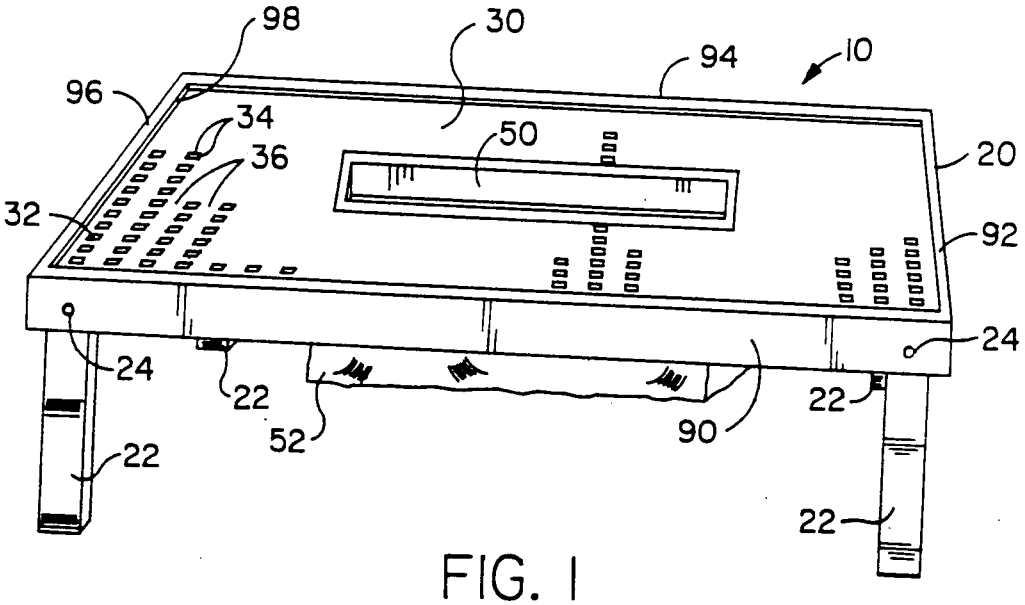
FIG. 1 is a perspective view of the play table in accordance with one embodiment of the present invention.

Referring to FIG. 1, there is illustrated one preferred embodiment of the play table 10 in accordance with the present invention. Play table 10 typically has a planar member 20 supported in a substantially horizontal direction by a plurality of legs 22. By utilizing the term "planar" it is meant that the horizontal member 20 has a dimension in one plane which is substantially greater than its dimension in the direction perpendicular to that plane. Although FIG. 1 shows planar member 20 to be supported by four legs 22, any number of legs which will solidly support planar member 20 may be utilized. Likewise, any other support means such as a pedestal base, end panels, and the like may be utilized. While planar member 20 may be supported merely by resting atop one or more boxes, saw horses, pedestals, or other support structure, planar member 20 is preferably secured to the support device, such as by bolts 24 as shown in FIG. 1. To prevent the appearance of the bolts 24 on the exterior of the play table 10, alternate securing means such as, for example, barrel bolts, may be used.

The upper surface of planar member 20 defines a play surface 30 having a plurality of recesses 32 which are sized and shaped to interconnect and interlock with the individual elements of a modular building system. Although recesses 32 may have a circular or star-shaped cross-section, the recesses desirably have a square cross-section, each side 34 of which has the dimension a. Also desirably, the perpendicular distance 36 between adjacent recesses equals a. The dimension a is preferably chosen to be substantially equivalent to or a multiple of the basic unit of length upon which the individual elements are based.

Figure 3:
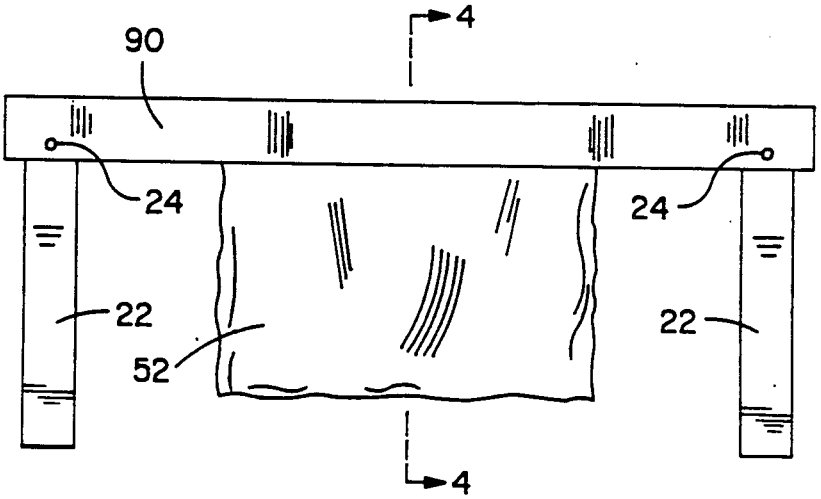
FIG. 3 is a side elevational view of the play table of FIG. 1.
Figure 2:
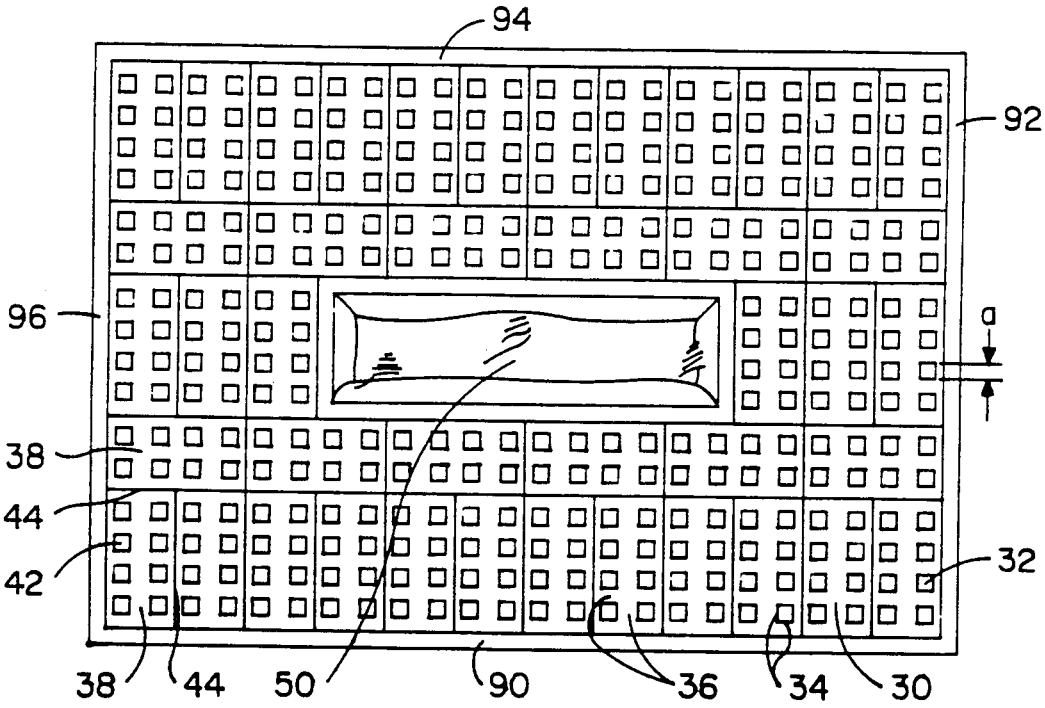
FIG. 2 is a plan view of the play table of FIG. 1.

In the preferred construction shown in FIGS. 1 and 3, the play surface 30 of planar member 20 is formed by individual segments 38 which are arranged in edge-wise fashion atop a support surface 40. Desirably, the length of segments 38 is twice the breadth of segments 38 so that the segments 38 may be neatly fitted adjacent one another in a variety of patterns to form play surface 30. Each of segments 38 has a plurality of through holes 42 which, when the segments are assembled atop the support surface 40, define recesses 32. Desirably, the perpendicular distance between through holes 42 and the outer edge 44 of segments 38 equals a/2 so that as segments 38 are arranged adjacent one another the perpendicular distance 36 between the recesses of adjacent segments equals a.

In forming play surface 30, it is preferable that the individual segments 38 are not fixedly attached to support surface 40. Thus, one, several or all of individual segments 38 may be selectively removed from support surface 40 to facilitate cleaning play table 10 and to enable one or more segments 38 to be utilized at a location remote from play table 10. Furthermore, the segments 38 which are removed from support surface 40 may be replaced by different segments 38' having through holes 42' which have a dimension a', where dimension a', is either smaller or larger than dimension a of the through holes 42 of segments 38. Thus, by replacing segments 38 with segments 38', the size of recesses 32 in play surface 30 may be either increased or decreased as desired.

As shown in FIG. 1, planar member 20 includes an opening 50 therethrough. Although shown in a central region of planar member 20, opening 50 may be located at any position in planar member 20, such as at one end, along an edge or in a corner.

Residing below planar member 20 is a storage compartment 52 which is removably attached to the periphery of opening 50 in communication therewith. Preferably, storage compartment 52 is in the form of a bag or pouch, although a more rigid box or other container may be employed.

In a preferred arrangement, the upper edge of storage compartment 52 is removably secured to the lower periphery of opening 50 by any means which will permit the easy removal of storage compartment 52. Such means may include snaps, clasps, zippers and the like. Alternatively, storage compartment 52 may be adapted to removably slide into a U-shaped channel or rest upon an L-shaped channel which is fixed to opening 50. When this type of attachment method is used in connection with a storage compartment formed from a bag or pouch, the bag or pouch desirably includes a relatively rigid upper periphery to facilitate the secure engagement with the channel. In a preferred mode of attachment, one portion of a hook and loop connector 54 is fixedly attached to the bottom periphery of opening 50. The opposite portion of the hook and loop connector 54 is fixedly attached to the upper edge of storage compartment 52. This type of attachment device permits storage compartment 52 to be readily connected to or disconnected from play table 10.

Figure 5:
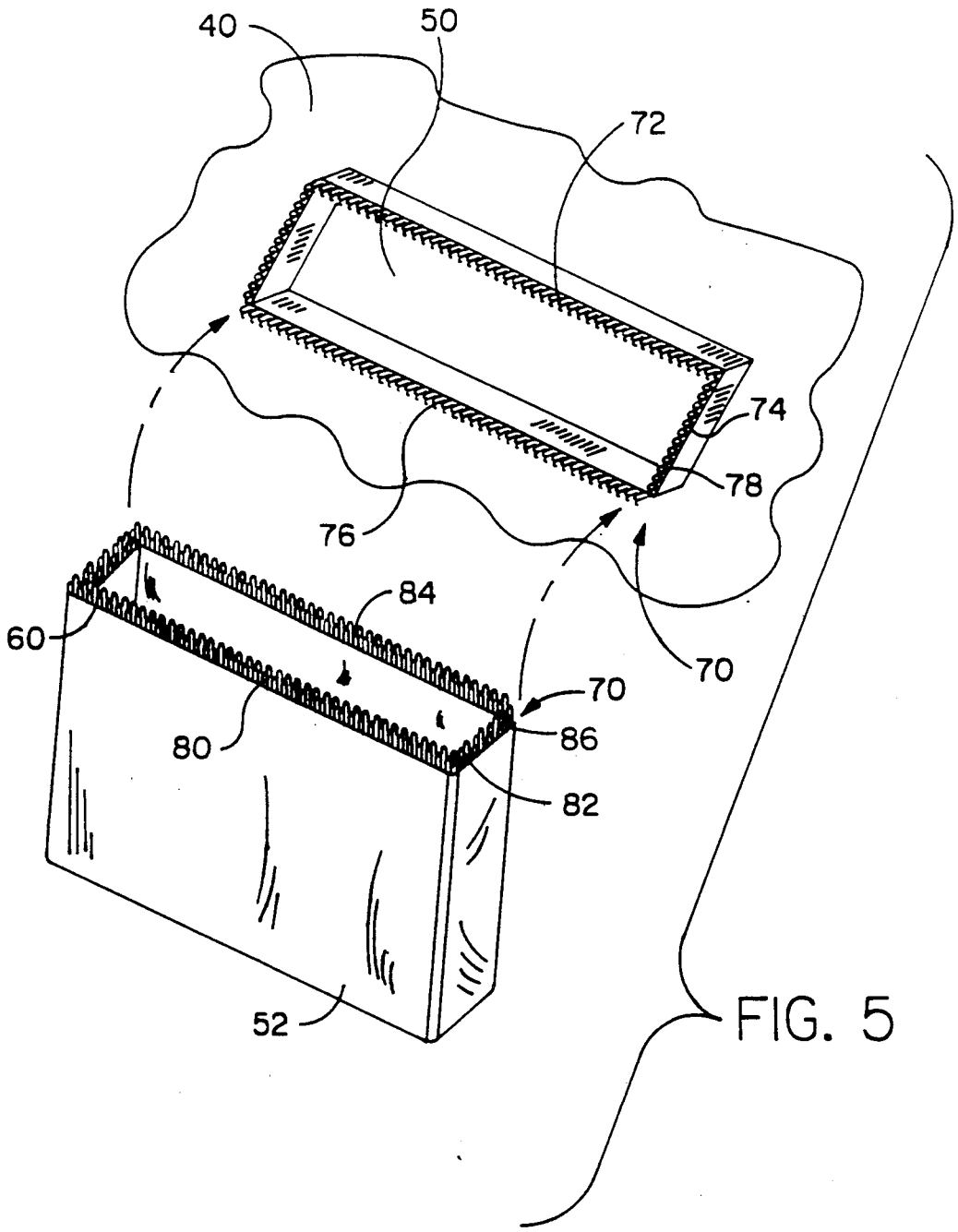
FIG. 5 is an exploded detail view showing the assembly of the storage compartment to the bottom of the play table of FIG. 1.

In a highly preferred mode of attachment, shown in FIG. 5, one portion 72 of a hook and loop connector 70 is fixedly attached to a region 74 consisting of approximately one half of the bottom periphery of opening 50. An opposite portion 76 of the hook and loop connector 70 is fixedly attached to a region 78 consisting of approximately the other half of the bottom periphery of opening 50. In a similar manner, a portion 80 of hook and loop connector 70 is fixedly attached to region 82 along the upper edge 60 of storage compartment 52, and an opposite portion 84 of hook and loop connector 70 is fixedly attached to the remaining region 86 along the upper edge 60 of storage compartment 52. For attachment to the bottom of planar member 20, storage compartment 52 is oriented so that region 82 is opposed to region 74 of opening 50, and region 86 is opposed to region 78 of opening 50, thereby enabling the opposite portions of hook and loop connector 70 to be joined. Upon its removal from the bottom of planar member 20, storage compartment 52 may be sealed closed by merely joining portions 80 and 84 of hook and loop connector 70.

Figure 6:
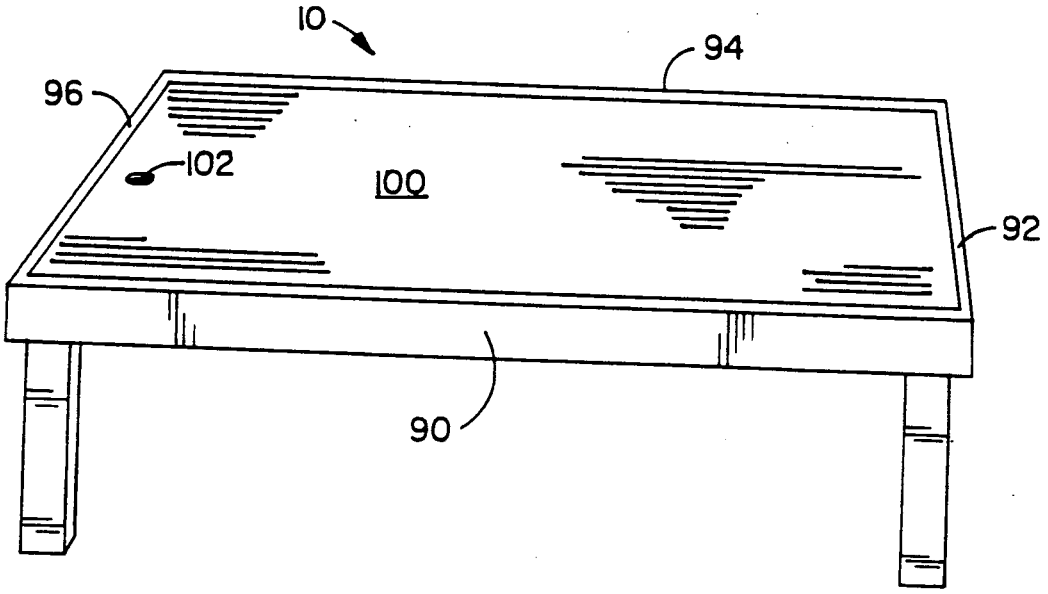
FIG. 6 is a perspective view showing the play table of FIG. 1 with the planar panel in place.

Edge rails 90, 92, 94 and 96 are assembled around the outer periphery of planar member 20 so that they protrude slightly above play surface 30. Thus, rails 90, 92, 94 and 96 define a shallow cavity 98 above and coextensive with play surface 30. Panel 100 is sized and shaped to optionally reside within cavity 98, thereby providing play table 10 with a smooth and flat upper surface, as shown in FIG. 6. Aperture 102 in panel 100 provides a finger grip to facilitate the insertion and removal of panel 100 from cavity 98. Thus, panel 100 enables play table 10 to be converted to a more or less conventional table when desired.

Figure 7:
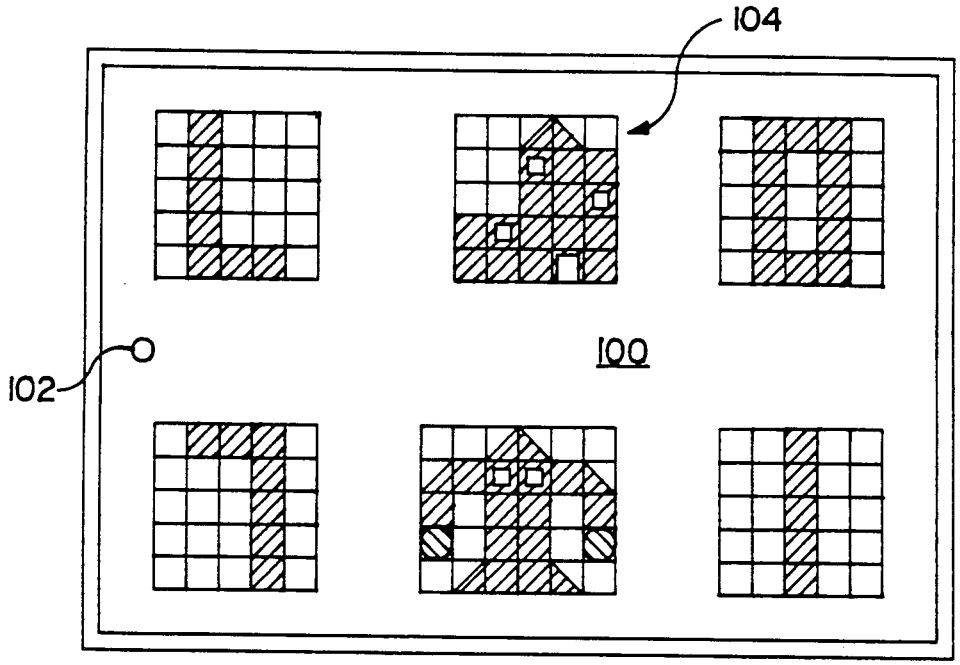
FIG. 7 is a plan view of the planar panel showing the design illustrations.
Figure 4:
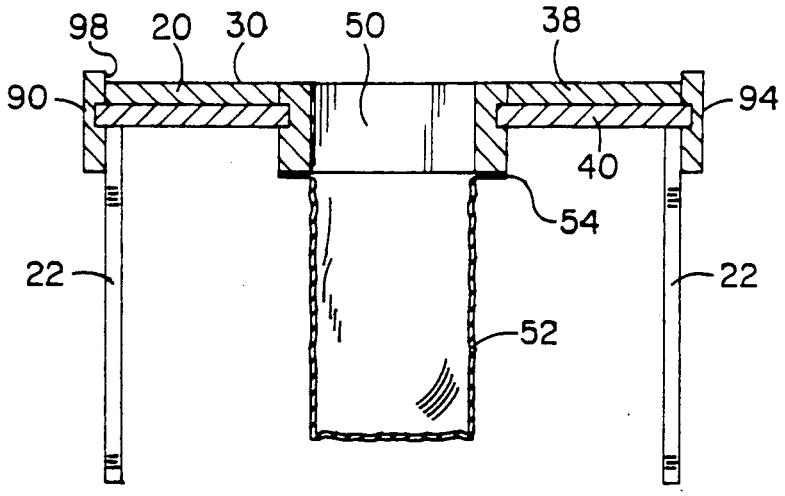
FIG. 4 is a sectional view taken along line 4—4 of FIG. 2.

Referring to FIG. 7, at least one side of panel 100 may include one or more illustrations of designs that can be reproduced with one form of the interlocking elements of the modular building system. These designs, indicated generally as 104, may include the letters of the alphabet, numbers, geometric patterns, simple structures and the like. Hence, panel 100 may be utilized to challenge children to duplicate a particular design by assembling the interlocking elements on the play surface 30.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised without departing from the spirit and scope of the present invention as defined by the appended claims.

I claim:

1. A table for use with a modular building system having a plurality of interlocking elements comprising, a generally planar member having a first region and a second region, said first region defining an opening through said planar member and said second region defining a support surface, at least one grid member removably disposed on said support surface, said grid member including a plurality of recesses sized and shaped to matingly receive said interlocking elements of said modular building system, a storage compartment associated with said first region for retaining said interlocking elements, and connecting means for removably connecting said storage compartment to said planar member in communication with said opening.

2. A table as claimed in claim 19 further comprising support means for supporting said planar member a predetermined distance from a horizontal surface.

3. A table as claimed in claim 2 further comprising a panel removably disposed atop and coextensive with said planar member to define on said planar member a substantially flat upper surface.

4. A table as claimed in claim 3 wherein at least one side of said panel includes illustrations of designs which are reproducible by assembling said interlocking elements on said play surface.

5. A table as claimed in claim 19 wherein said connecting means provides means for maintaining said storage compartment in a closed condition upon removal of said storage compartment from said planar member.

6. A table as claimed in claim 5 wherein said connecting means comprises a hook and loop connector, a first portion of said hook and loop connector being fixedly attached to said planar member and an opposite portion of said hook and loop connector being fixedly attached to said storage compartment for mating engagement with said first portion.

7. A table as claimed in claim 6 wherein said storage compartment comprises a bag.

8. A table as claimed in claim 7 further comprising support means for supporting said planar member a predetermined distance from a horizontal surface.

9. A table as claimed in claim 8 further comprising a panel removably disposed atop and coextensive with said planar member to define on said planar member a substantially flat upper surface.

10. A table as claimed in claim 9 wherein at least one side of said panel includes illustrations of designs which are reproducible by assembling said interlocking elements on said play surface.

11. A table as claimed in claim 19 wherein said plurality of recesses have a square cross-section the sides of which have a predetermined dimension, said recesses being spaced apart by said predetermined dimension in directions perpendicular to the sides of said recesses.

12. A table as claimed in claim 11 wherein said connecting means provides means for maintaining said storage compartment in a closed condition upon removal of said storage compartment from said planar member.

13. A table as claimed in claim 12 wherein said connecting means comprises a hood and loop connector, a first portion of said hook and loop connector fixedly attached to said planar member and a second portion of said hook and loop connector fixedly attached to said storage compartment.

14. A table as claimed in claim 13 wherein said storage compartment comprises a bag.

15. A table as claimed in claim 14 further comprising support means for supporting said planar member a predetermined distance from a horizontal surface.

16. A table as claimed in claim 15 further comprising a panel removably disposed atop and coextensive with said planar member to define on said planar member a substantially flat upper surface.

17. A table as claimed in claim 16 wherein at least one side of said panel includes illustrations of designs which are reproducible by assembling said interlocking elements on said play surface.

18. A play system comprising, a modular building system having a plurality of interlocking elements, a generally planar member having a first region and a second region, said first region defining an opening through said planar member and said second region defining a support surface, at least one grid member removably disposed on said support surface, said grid member including a plurality of recesses sized and shaped to matingly receive said interlocking elements of said modular building system, a storage compartment associated with said first region for retaining said interlocking elements, connecting means for removably connecting said storage compartment to said planar member in communication with said opening, and a panel removably disposed atop and coextensive with said grid member to define on said grid member a substantially flat upper surface, at least one side of said panel including illustrations of designs which are reproducible by assembling said interlocking elements on said grid member.

* * * * *

UNITED STATES PATENT AND TRADEMARK OFFICE

CERTIFICATE OF CORRECTION

PATENT NO. : 5,055,081

DATED : October 8, 1991

INVENTOR(S) : Nayak

It is certified that error appears in the above-identified patent and that said Letters Patent is hereby corrected as shown below:

Column 5, line 15, delete "19" and insert --1--.
Column 5, line 26, delete "19" and insert --1--.
Column 5, line 50, delete "19" and insert --1--.
Column 6, line 9, delete "hood" and insert --hook--.

Signed and Sealed this

Thirteenth Day of April, 1993

*Attest:*

STEPHEN G. KUNIN

*Attesting Officer*

*Acting Commissioner of Patents and Trademarks*